United States Patent [19]

Phillips et al.

[11] 4,010,231

[45] Mar. 1, 1977

[54] METHOD OF SEALING LEAKS IN METAL OIL STORAGE CONTAINERS

[75] Inventors: Kenneth G. Phillips, River Forest; Alvin J. Frisque, La Grange, both of Ill.

[73] Assignee: Nalco Chemical Company, Oak Brook, Ill.

[22] Filed: May 22, 1974

[21] Appl. No.: 472,398

[52] U.S. Cl. ..... 264/35; 252/72; 260/29.6 H; 260/29.6 HN; 260/29.6 WQ; 260/29.65 Q; 264/32; 264/36

[51] Int. Cl.[2] ..... E04B 1/16

[58] Field of Search ..... 260/29.6 H, 29.6 HN, 260/29.6 WQ, 29.6 SQ; 264/32, 35, 36; 252/72

[56] References Cited

UNITED STATES PATENTS

| | | | |
|---|---|---|---|
| 3,282,874 | 11/1966 | Friedrich et al. | 252/72 |
| 3,630,914 | 12/1971 | Nankee et al. | 252/72 |
| 3,721,295 | 3/1973 | Bott | 166/294 |

*Primary Examiner*—Eugene C. Rzucidlo
*Attorney, Agent, or Firm*—John G. Premo; John S. Roberts

[57] ABSTRACT

This invention relates to sealing small leaks in oil containers such as tankers, underground storage tanks, and the like, by plugging the orifice of the leak utilizing water-soluble polymers which have been dispersed in a water-in-oil emulsion wherein the oil is the continuous phase.

The active sealant consists of small densely packed spheres of the water-soluble polymers which have an effective size of about 0.5–500 microns. The dosage on an oil-wet surface is about 3–15 percent based on the weight of the oil present and may alternatively be measured as about 10–1000 ppm of polymer spheres applied to the orifice.

3 Claims, No Drawings

METHOD OF SEALING LEAKS IN METAL OIL STORAGE CONTAINERS

This invention relates to sealing small leaks in oil containers such as tankers, underground storage tanks, and the like, by plugging the orifice of the leak utilizing water-soluble polymers which have been dispersed in a water-in-oil emulsion wherein the oil is the continuous phase.

The active sealant consists of small densely packed spheres of the water-soluble polymers which have an effective size of about 0.5–500 microns. The dosage on an oil-wet surface is about 3–15 percent based on the weight of the oil present and may alternatively be measured as about 10–1000 ppm of polymer spheres applied to the orifice.

PRIOR ART

General

U.S. Pat. No. 2,982,749 Friedrich et al. (DOW) teaches a water-in-oil suspension polymerization wherein a water-soluble ethylenically unsaturated monomer is polymerized in an inert hydrophobic liquid organic dispersion media to produce a dispersed phase polymeric product in bead form.

U.S. Pat. No. 3,282,874 Friedrich et al. (DOW) disperses a pre-formed organic polymer in an inert water-immiscible organic liquid which is a non-solvent for the polymer to produce aqueous polymer gels.

U.S. Pat. No. 3,284,393 Vanderhoff et al. (DOW) teaches the polymerization of water-soluble monomers utilizing an emulsion technique wherein the oil phase is the continuous phase.

U.S. Pat. No. 3,504,746 Freifeld et al. (GAF) utilizes an ungelled non-crosslinked composition of a polyvinyl pyrrolidone polymer to be used as a sealant in a walled system.

U.S. Pat. No. 3,630,914 Nankee et al. (DOW) utilizes polyacrylamide dry added to an automobile radiator as a leak stopper.

Particle Shape

U.S. Pat. No. 2,944,018 Borcherdt describes preferred form of particles in variations of wedge-like shape utilized for leak stopping in drilling fluids.

U.S. Pat. No. 3,644,208 Krueger (DuPont) teaches polystyrene spheres partially hollow mixed with polystyrene PVP polymer as a leak stopper in heat exchangers.

Recent Developments

As an example of recent development in water-soluble polymers which are subsequently inverted in water are:

U.S. Pat. No. 3,734,873 Anderson et al (Nalco)
U.S. Pat. No. 3,790,476 Spoerle et al (Nalco)
U.S. Pat. No. 3,790,477 Nielsen et al (Nalco)

THE POLYMER AND WATER-IN-OIL EMULSION

In accordance with this invention, an improved method of leak stopping has been discovered comprising the use of a water-in-oil emulsion of a water-soluble vinyl addition polymer. The polymeric latex is produced by the steps of:

A. Forming a water-in-oil emulsion from:

1. water which contains dissolved therein a water-soluble ethylenic unsaturated monomer, thereby producing a monomer phase which has a concentration of from 30–70% by weight of said emulsion;
2. an inert hydrophobic liquid;
3. a water-in-oil emulsifying agent in a concentration of from 0.1–10% by weight;
4. a free radical initiator;

B. Heating said emulsion under free radical forming conditions to polymerize the water-soluble ethylenic unsaturated monomer forming a polymer which is contained in the emulsion; and C. Polymerizing said monomer in the water-in-oil emulsion to produce a polymeric latex.

This process produces a polymeric latex which comprises a water-in-oil emulsion which contains dispersed therein a finely divided water-soluble vinyl addition polymer.

The finely divided water-soluble vinyl addition polymer is used in the form of spheres which act to block the orifice of the leak on the enclosed or near side of the metal container. The spheres are densely packed and range in size from about 500 microns down to about 0.5 microns, which will block an opening of 0.500 to 0.00050 millimeters [cf. Lange's *Handbook of Chemistry*, 11th Ed., 1973, page 11–2]. Thus, these polymers afford an effective remedy for small leaks in underground storage tanks, oil tankers, and generally for oil containers.

The dosage needed to seal the orifice of the leak requires about 10–1000 ppm of polymer calculated as spheres and, when applied to an oil-wet surface alternatively, about 3–15 weight percent of the water-in-oil emulsion is utilized where the percent calculation is based upon the amount of oil present.

This process involves the formation of an emulsion by the addition of a monomer phase to an oil phase containing an emulsifying agent. The monomer phase is comprised of water-soluble ethylenic unsaturated monomer in an aqueous solution. The monomer phase concentration may range from 30–70% by weight of the emulsion. The oil phase is any inert hydrophobic liquid such as hydrocarbons and substituted hydrocarbons. The inert hydrophillic liquid concentration ranges from 5–40% by weight of the emulsion. Any emulsifying agent which is oil soluble is acceptable.

All known polymerizable water-soluble ethylenic unsaturated monomers, the polymers of which are insoluble in the continuous oil phase, can be polymerized by a water-in-oil emulsion polymerization process to give a polymeric latex. Such monomers have a water solubility of at least 5 weight percent and include acrylamide, methacrylamide, acrylic acid, methacrylic acid, vinyl benzyl dimethyl ammonium chloride, alkali metal and ammonium salts of a 2-sulfoethylacrylate, sodium styrene sulfonate, 2-aminoethylmethacrylate hydrochloride, alkali metal and ammonium salts of vinyl benzyl sulfonates and the like. Preferred copolymers of this invention are the copolymers of acrylamide with either sodium acrylate or dimethylaminoethyl methacrylate. The most preferred copolymer of acrylamide is that with the dimethyl sulfate quat of dimethylaminoethyl methacrylate. Extremely excellent results have been obtained using this particular copolymer. The preferred ratio of acrylamide to sodium acrylate is 70:30 while the preferred ratio of acrylamide to the dimethyl quat of dimethylaminoethyl methacrylate is 95:5. The ratio of acrylamide to the dimethyl quat of dimethylaminoethyl methacrylate may range from 95:5 to 60:40. When aqueous solutions of the monomers are used, they can vary widely in monomer content. Proportions between 70 and 30% by weight monomer correspondingly to 30 to 70% water are used, depending upon the monomer and the temperature of polymerization. Addition of water-soluble divinyl cross-linking materials such as methylenebis acrylamide or the diester of acrylic acid with ethyleneglycol makes the oil-leak suppressant water resistant in applications where this property is needed. The amount of cross linking agent need not be great. Amounts ranging from 0.5% up to about 3% by weight provide adequate insolubilization of the water soluble polymers.

The ratio of monomer phase to oil phase is also widely variable, advantageously between 30 and 70 parts of the former to between 70 and 30 parts of the latter by weight. A monomer phase to oil phase ratio of about 70 to 30 is preferred.

In this specification and claims the term "acrylate" is defined as alkali metal acrylate such as sodium or potassium acrylate, and the term "polyacrylate" has a corresponding meaning.

In order to emulsify the monomer phase into the oil phase to give a water-in-oil emulsion, an emulsifying agent of the water-in-oil type is used in amount ranging between 0.1 and 10% by weight of the oil phase. Any conventional water-in-oil emulsifying agent can be used, such as hexadecyl sodium phthalate, sorbitan monooleate, sorbitan monostearate, cetyl or stearyl sodium phthalate, metal soaps, and the like.

The oil phase can be any inert hydrophobic liquid which can readily be separated from the disperse phase polymeric product.

A preferred group of organic liquids are the hydrocarbon liquids which include both aromatic and aliphatic compounds. Thus, such organic hydrocarbon liquids as benzene, xylene, toluene, mineral oils, kerosenes, naphthas and, in certain instances, petrolatums may be used. A particularly useful oil from the standpoint of its physical and chemical properties is the branch-chain isoparaffinic solvent sold by Humble Oil and Refining Company under the tradename "ISOPAR M." Typical specifications of this narrow-cut isoparaffinic solvent are set forth below in Table I:

TABLE I

| Specification properties | Minimum | Maximum | Test Method |
|---|---|---|---|
| Gravity, API at 60/60° F | 48.0 | 51.0 | ASTM D 287 |
| Color, Saybolt | 30 | — | ASTM D 156 |
| Aniline point, ° F | 185 | — | ASTM D 611 |
| Sulfur, ppm | — | 10 | ASTM D 1266 (nephelometric mod.) |
| Distillation, ° F: | | | |
| IBP | 400 | 410) | |

TABLE I-continued

| Specification properties | Minimum | Maximum | Test Method |
|---|---|---|---|
| Dry Point | | 495) | ASTM D 86 |
| Flash point, ° F (Pensky-Martens closed cup) | 160 | — | ASTM D 93 |

Free-radical yielding initiators useful in polymerizing ethylenic unsaturated monomers, such as benzoyl peroxide, lauroyl peroxide, 2,2'-azobis(isobutyronitrile), potassium persulfate and the like are used in the polymerization, advantageously in amounts ranging between 0.02 and 1.0% by weight of the oil or monomer phase, depending upon the solubility of the initiator. Polymerization can also be carried out using high energy irradiation, or high energy electrons from a Van de Graaff accelerator, etc., or ultraviolet irradiation.

Elevated reaction temperatures, advantageously between 40° and 70° C., are used with free radical yielding initiators. Within such a temperature range, conversion is substantially complete in from one-half hour to several days, depending upon monomer and reaction variables. High energy or ultraviolet irradiation polymerization is carried out at room temperature or above or below room temperature, as desired.

EXAMPLE

A 50,000-gallon metal container containing fuel oil was drained down to about 500 gallons. The container had a history of small leaks when filled to about one-half capacity or above and these small leaks had created problems of disposal as well as possible conflicts with EPA.

A water-in-oil emulsion was prepared according to Example 5 of Anderson et al. U.S. Pat. No. 3,734,873, noted above, producing a homopolymer of polyacrylamide. This emulsion contained a multiplicity of densely packed polymer spheres of about 0.5–10 microns in size. 50 gallons of the emulsion was introduced into the tank and after a six-hour period, it was noted that the small leaks had disappeared.

Additional experiments in the series of 10 tanks drained down to about 500 gallons and varying from 15–75 gallons treating agent also resulted in substantially stopping all small leaks within a 3–6 hour period.

We claim:

1. A method of sealing small leaks in metal oil storage containers which comprises applying to the orifice of the leak a dosage of from about 10–1000 ppm of a water-in-oil emulsion of a water-soluble vinyl addition polymer containing small polymer spheres of an effective size of about 0.5–500 microns.

2. The method according to claim 1 wherein the water-soluble vinyl addition polymer is a homopolymer of acrylamide.

3. The method according to claim 1 wherein the water-soluble vinyl addition polymer is a copolymer of acrylamide and sodium acrylate.

* * * * *